United States Patent [19]

Dixon

[11] Patent Number: 4,819,575

[45] Date of Patent: Apr. 11, 1989

[54] MARINE CONVERSION FOR CYCLE

[76] Inventor: Jimmie D. Dixon, 7146 W. Bluefield Ave., Peoria, Ariz. 85345

[21] Appl. No.: 47,465

[22] Filed: May 11, 1987

[51] Int. Cl.[4] ..... B63B 35/86

[52] U.S. Cl. ..... 114/270; 440/11; 440/90

[58] Field of Search ..... 114/61, 58, 270, 288, 114/290, 291, 292, 56, 57; 440/11, 12, 21, 90, 98, 100

[56] References Cited

U.S. PATENT DOCUMENTS

| | | | |
|---|---|---|---|
| 1,646,664 | 10/1927 | Sanni | 114/270 |
| 1,869,139 | 7/1932 | Gargiulo | 114/270 |
| 2,979,016 | 4/1961 | Rossi | 114/270 |
| 3,606,856 | 9/1971 | Moraga | 114/270 |
| 3,628,493 | 12/1971 | Hendrick | 440/90 |
| 4,050,399 | 9/1977 | Mochel | 440/12 |
| 4,395,237 | 7/1983 | Watanabe | 114/270 |
| 4,494,937 | 1/1985 | Riermann | 440/11 |
| 4,522,420 | 6/1985 | Hannappel | 280/289 A |
| 4,597,353 | 7/1986 | Takezond | 114/270 |
| 4,671,774 | 6/1987 | Owsen | 114/270 |

*Primary Examiner*—Sherman D. Basinger
*Assistant Examiner*—Stephen P. Avila
*Attorney, Agent, or Firm*—Cahill, Sutton & Thomas

[57] ABSTRACT

An engine powered cycle is converted for use on water by attaching an elongated float to a steering wheel support and by replacing the driving wheels with a pair of paddle floats. Another float positioned between and aft of the paddle floats may be employed to increase buoyancy. The paddle floats mount on the ends of the drive shaft of the cycle and extend transversely outwardly thereof distances substantially in excess of the width of the wheels they replace to increase the buoyancy and stability of the cycle.

5 Claims, 1 Drawing Sheet

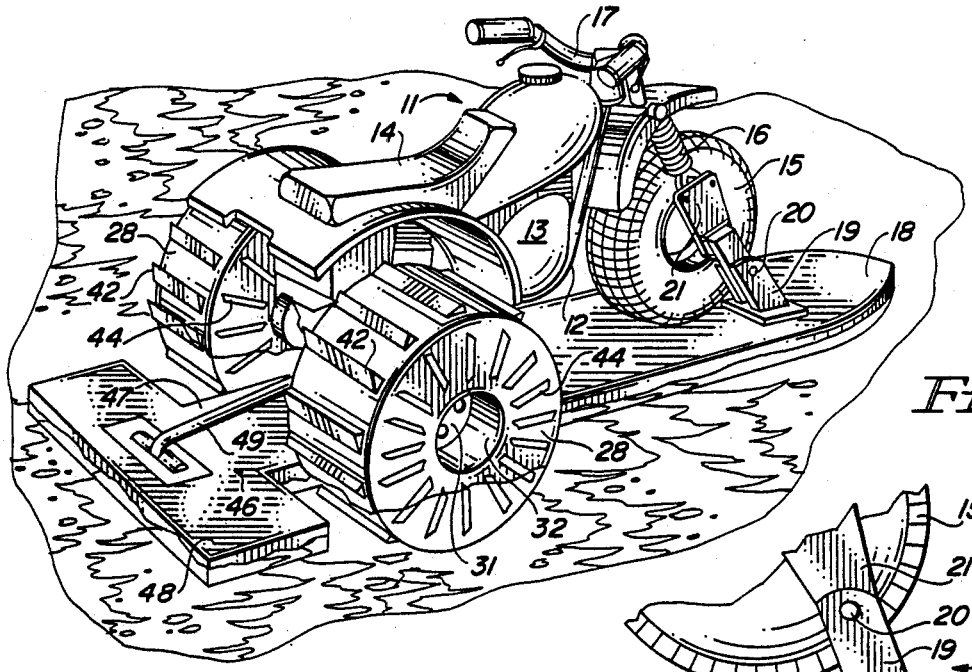
FIG. 1
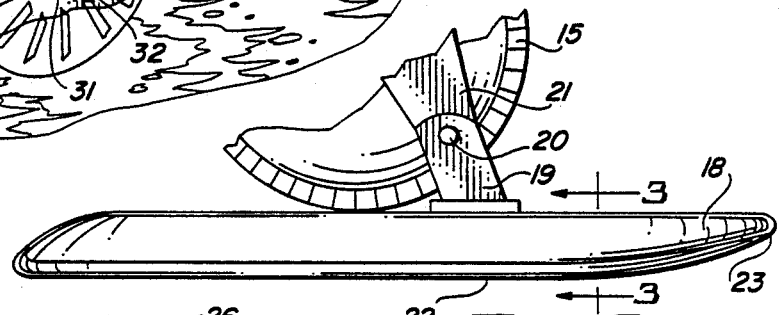
FIG. 2
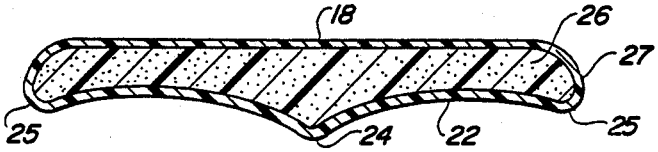
FIG. 3
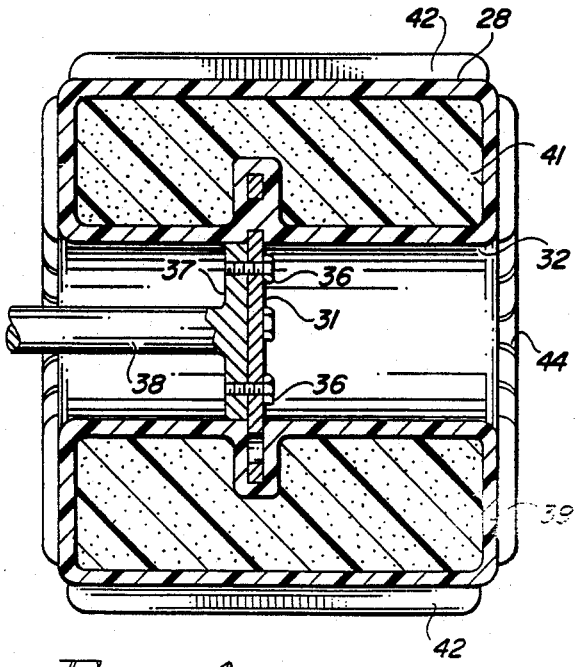
FIG. 4
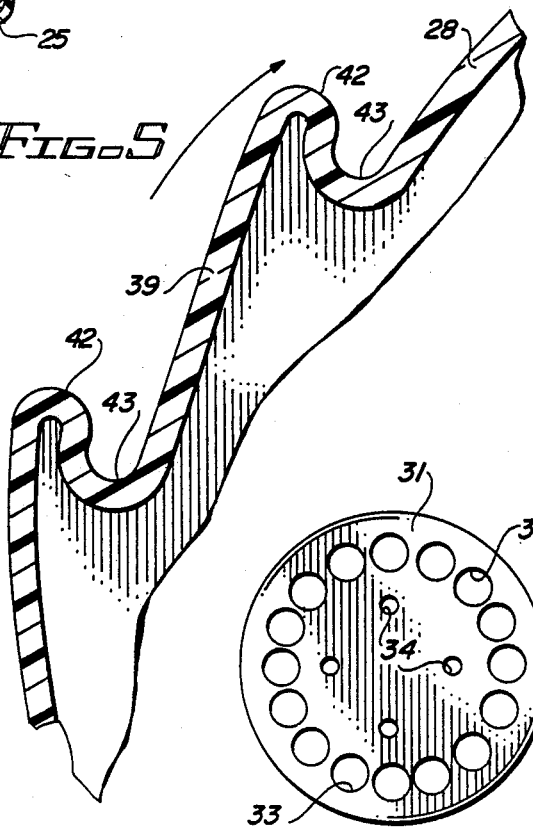
FIG. 5
FIG. 6

MARINE CONVERSION FOR CYCLE

TECHNICAL FIELD

This invention involves the conversion of all terrain cycles to operate on water.

BACKGROUND ART

All terrain cycles, or "ATC's", as they have come to be known, have become popular vehicles for off-road recreational use. Not unexpectedly, the idea of converting the ATC's for use on water has been proposed by others. U.S. Pats. No. 4,494,937 granted Jan. 22, 1985 to F.H. Riermann for "Pontoon Attachment for All Terrain Vehicle" and U.S. Pat. No. 4,522,420 granted June 11, 1985 to G.J. Hannappel for "All Terrain Vehicle Conversion System" disclose the idea of attaching outrigger pontoons to a motorized tricycle so the vehicle can be operated on water. The mounting systems in both of these patents are rather complex and require the use of a multitude of detachable struts and fasteners. The systems also require separate and complex drive, or propulsion, systems and steering mechanisms.

In marine conversion systems for other types of vehicles it has been suggested that the wheels of the vehicle be replaced with rotatable floats to support the vehicle on the surface of the water and to propel the vehicle over the water. U.S. Pat. No. 2,979,016 granted Apr. 11, 1961 to S.J. Rossi for "Amphibious Conversion Attachments for Automobiles and Like Vehicles" suggests replacing the wheels of the vehicle with cylindrical paddle floats. U.S. Pat. No. 3,628,493 granted Dec. 21, 1971 to E. E. Hendrick for "Impeller Wheel for Amphibious Vehicles" discloses a hulled vehicle with rotating impellers which can also serve as wheels when the vehicle is operated on land. And U.S. pat. No. 3,606,856 granted Sept. 21, 1971 to E. O. Moraga for "Ciclo Amphibious" discloses a tricycle vehicle utilizing near spherical wheels which are intended to permit the cycle to operate on water. So far as is known, none of these systems have produced commerically acceptable vehicles.

DISCLOSURE OF THE INVENTION

This invention contemplates a fairly simple conversion system for ATC's employing a combination of specifically configured paddle floats replacing the drive wheels of the vehicle and a ski-like float associated with a steering wheel of the vehicle. This minimal modification of the ATC produces a marine vehicle which is stable, readily propelled and easily steered.

BRIEF DESCRIPTION OF THE DRAWING

FIG. 1 is a three-quarter rear perspective view of an all terrain tricycle embodying this invention;

FIG. 2 is an enlarged fragmentary elevational view of a float associated with the steering wheel of the cycle of FIG. 1;

FIG. 3 is a sectional view through the float taken generally as indicated by lines 3—3 in FIG. 2;

FIG. 4 is a vertical sectional view through a paddle float used in the invention;

FIG. 5 is an enlarged sectional view through the wall of a paddle float; and

FIG. 6 is a view of the face of a mounting plate forming a part of a paddle float.

BEST MODE FOR CARRYING OUT THE INVENTION

Referring particularly to FIG. 1, the numeral 11 designates generally a motorized, all terrain tricycle having a frame 12 supporting a gasoline engine 13, a rider's seat 14 and a steerable front wheel 15. Wheel 15 is carried in a yoke 16 rotatably mounted on the frame 12 and attached to handlebars 17 by which the vehicle is normally steered.

One of the principal components of the marine conversion of this invention is an elongated, ski or board-like float 18 positioned beneath steerable wheel 15. The mounting system for float 18 comprises a pair of brackets 19 mounted on the upper surface of the float and pivotally connected at 20 to a pair of connecting links 21 which are fastened to the arms of yoke 16.

Float connecting links 21 are detachably fastened to yoke 16 by any suitable means, such as bolts, to permit removal of float 18 when cycle 11 is to be operated on land. Alternatively, the float 18 can be detached from the cycle 11 by removing the hinge pins providing the pivotable connections 20. With the latter arrangement links 21 can remain bolted to the steering wheel yoke when the vehicle is operated on land.

Float 18 is employed to provide partial flotational support for the cycle 11 on water and to effect steering of the cycle on the water. The preferred configuration of float 18 is illustrated in FIGS. 2 and 3. The bottom 22 of float 18 is preferably swept upwardly at the front, or bow, portion 23 of the float to facilitate movement of the float through the water and to reduce any tendency for the float to dive or plow through the water. Effectiveness of the float 18 as a steering member can be enhanced by forming a keel, or skeg, 24 along the longitudinal center line of the float bottom 22 and additional keels or skegs, 25 can be provided at the chine of the float.

Float 18 preferably is hollow, with a relatively thin wall structure 27 and may be filled with a light-weight, water resistant material 26, such as, for example, an expanded polystyrene foam or a polyurethane foam. Wall structures 27 of float 18 is preferably molded from a tough, impact resistant material, such as polyethylene plastic, by a rotational molding process which is hereinafter described.

Steering the cycle on water is accomplished in the same manner as is done on land; the rider merely turns the handlebars 17 in the direction he wishes the vehicle to turn. Because float 18 is attached to steering wheel yoke 16, any lateral turning movement of the wheel 15 translates into a similar lateral turning movement of float 18. As the float 18 is moved through the water keels 24 and 25 create forces on the board 18 causing the cycle to turn. This float 18 steering wheel 15 assembly thus provides a simple, yet effective, means for both floating the cycle and steering the cycle. It will be noted that no separate rudder and rudder actuating system are required as has been the case with some prior marine conversion systems, such as those mentioned previously. It can be appreciated that if the cycle to be converted has four wheels either one or two such floats 18 can be associated with the front steerable wheels.

The second principal component of the marine conversion of this invention is a pair of cylindrical paddle floats 28 which replace the drive wheels of the cycle 11. Floats 28 provide partial flotation support for the cycle and are driven by the cycle engine 13 to propel the cycle over the water.

Each paddle float 28 has a toroidal configuration (See FIGS. 1 and 4) with the generatrix being an elongated rectangle. Each paddle float 28 has a width substantially in excess of the width of the drive wheel it replaces in order to provide adequate buoyancy, or flotation, for the cycle 11 and its rider. Stated differently, the paddle floats 28 extend transversely away from the center line of the cycle 11 distances which are substantially greater than the transverse extent of the replaced drive wheels. To accommodate the oversize paddle floats 28 to the cycle 11 the means for mounting the paddle floats 28 to the drive wheel mounting means of the cycle should be positioned inwardly of the center lines of the paddle floats. This is illustrated in FIG. 4 which is a sectional view of the right paddle float 28.

The mounting means for mounting each paddle float on the cycle preferably comprises an upright circular plate 31 positioned in the central opening 32 of the paddle float (See FIGS. 4 and 6). Plate 21 has an outer array of openings 33 by which the plate is affixed to the paddle float and an inner array of openings 34 to receive bolts or studs 36 for connecting the plate to a wheel mounting flange 37 on wheel mounting shaft 38. This mounting arrangement for the paddle floats 28 is identical to the mounting arrangement for the land drive wheels of the cycle 11, so the marine conversion is a simple procedure in which the same bolts, or studs, 36 which mount the drive wheels can be used to mount the paddle floats 28. If the cycle to be converted has four wheels all four can, if desired, be replaced with paddle floats 28.

Paddle floats 28 are preferably hollow, with a relatively thin wall structure 39, and may, if desired, be filled with a light-weight water resistant material 41 such as, for example, polyurethane foam. The wall structure 39 of each float 28 is preferably molded from a tough, impact resistant material, such as, for example, polyethylene plastic, by a rotational molding process. This process is particularly suited for molding thin walled, but strong, hollow articles, such as float 18 and paddle floats 28.

In rotational molding a split mold having a configuration of the article to be molded is loaded with a quantity of plastic powder sufficient to form the article. The mold parts are tightly joined and the mold is heated to first fluidize and then cure the plastic as the mold is rotated on two different axes and at different speeds. The process causes the formation of a substantially uniform layer of cured plastic over the interior of the mold, thus forming a hollow article. Virtually any wall configuration can be imparted to the article.

In forming each of the paddle floats 28 to a two part mold is provided which is split in a plane containing the mounting plate 31. Cores in each part of the mold, which form the central opening 32 in the float, are designed to meet and hold mounting plate 31 therebetween during the molding process. The outer perimeter of plate 31, including openings 33 therein, is exposed to the interior of the mold so this portion of the plate 31 becomes encased in the wall structure 39 of the float during the forming process (See FIG. 4). In this manner the mounting plate 31 is securely affixed to the float during manufacture of the latter.

As mentioned previously, rotational molding of floats 18 and 28 can give these articles virtually any wall configuration desired. And it is desirable to configure the walls of the paddle floats 28 to enhance their capability of propelling the cycle 11 over the water.

As best shown in FIG. 5, the outer wall structure 39 of each paddle float 28 is preferably shaped to provide a plurality of paddles 42 extending transversely across the float. The leading face of each paddle 42 can be recessed as indicated at 43, to further increase the propulsive force generated when the paddle float is rotated.

Also, if desired, the inner and outer faces of each paddle float 28 can be provided with radially extending paddles 44 to further increase the propulsive forces generated by the paddle floats.

For marine cycles 11 destined to carry a heavy rider it is desirable to provide another, or auxiliary, float 46 between paddle floats 28. Auxiliary float 46 can be T-shaped with its stem 47 extending rearwardly from between paddle floats 28 to a transversely extending section 48.

The construction of auxiliary float 48 is preferably the same as that described above with reference to elongated float 18. Float 48 can be mounted on the cycle 11 by any suitable means such as bracket 49 extending from the float and bolted or otherwise fastened to the frame 12 of the cycle.

From the foregoing it should be apparent that this invention provides a convenient and effective marine conversion for an all terrain cycle.

What is claimed is:

1. In a marine conversion for an engine powered cycle normally possessing a steerable wheel and a pair of drive wheels, the combination of an elongated float positioned beneath the steering wheel and secured to the support for said wheel whereby the float turns laterally, drive wheel mounting means comprising a drive shaft and a drive flange for each of said drive wheels, a pair of rotatable paddle floats mounted on the cycle in place of said pair of drive wheels, each of said paddle floats having an inboard side and an outboard side, each of said paddle floats having a toroidal configuration and having a central opening therethrough sized to receive the drive flange of said wheel mounting means, a mounting plate carried by each of said floats and extending across the opening through its respective float intermediate the inboard and outboard sides of the float, each said mounting plate having a set of openings therein for connecting the plates to said drive flanges.

2. The combination of claim 1 further characterized in that the mounting plate of each of said paddle float is positioned closer to the inboard side of its float than to the outboard side of its float.

3. The combination of claim 1 further characterized in that each said paddle float is formed with molded plastic walls and the mounting plate therein is molded in place in said walls.

4. The combination of claim 3 further characterized in that each said mounting plate has a second set of openings therein receiving the plastic material forming the walls of its paddle float.

5. The combination of claim 1 further comprising another float having portions thereof disposed between and positioned rearwardly of said paddle floats.

* * * * *